United States Patent [19]

Hertel et al.

[11] 4,183,727

[45] Jan. 15, 1980

[54] PROCESS FOR THE PRODUCTION OF WATER-INSOLUBLE AZO DYESTUFFS ON THE FIBER

[75] Inventors: Hasso Hertel, Mühlheim; Peter Frey, Hofheim am Taunus, both of Fed. Rep. of Germany

[73] Assignee: Hoechst Aktiengesellschaft, Fed. Rep. of Germany

[21] Appl. No.: 914,924

[22] Filed: Jun. 12, 1978

Related U.S. Application Data

[63] Continuation of Ser. No. 802,495, Jun. 1, 1977, abandoned.

[30] Foreign Application Priority Data

Jun. 5, 1976 [DE] Fed. Rep. of Germany ..... 2625517

[51] Int. Cl.[2] ..... C09B 27/00

[52] U.S. Cl. ..... 8/46; 8/44; 8/54.2

[58] Field of Search ..... 8/44, 46

[56] References Cited

U.S. PATENT DOCUMENTS

| | | | |
|---|---|---|---|
| 1,975,409 | 10/1934 | Schnitzspan | 8/44 |
| 2,178,744 | 11/1939 | Ellis et al. | 8/24 |
| 3,288,552 | 11/1966 | Streck | 8/44 |
| 3,561,914 | 2/1971 | Abel et al. | 8/43 |
| 3,697,216 | 10/1972 | Hertel et al. | 8/46 |
| 3,711,245 | 1/1973 | Neumer | 8/21 R |
| 4,035,144 | 7/1977 | Hertel | 8/44 |
| 4,082,503 | 4/1978 | Hertel | 8/44 |

*Primary Examiner*—A. Lionel Clingman
*Attorney, Agent, or Firm*—Connolly and Hutz

[57] ABSTRACT

An improved process for the preparation of water-insoluble azo dyestuffs on vegetable fibers according to the method of the ice-color technique had been found, impregnating first the fibrous material with an azo component and then developing it with a diazo solution of an aromatic amino compound in the neutral or slightly alkaline range, wherein an alkali metal borate is used to neutralize the diazo solution.

The dyeings prepared in this improved dyeing process for ice color dyeing have very good fastness properties and are obtained with high color yields. The improvement of the dyeing process is seen in the use of alkali metal borate as a neutralizing agent, which avoids the creation of foam in the surfactant-containing diazo solution.

2 Claims, No Drawings

PROCESS FOR THE PRODUCTION OF WATER-INSOLUBLE AZO DYESTUFFS ON THE FIBER

This application is a continuation of application Ser. No. 802,495 filed June 1, 1977 now abandoned.

The present invention provides an improved process for producing water-insoluble azo dyestuffs on the fiber according to the methods of the ice color technique.

As has already been known, water-insoluble azo dyestuffs are produced on the fiber by the reaction of a diazonium compound with an azo component. This process is carried out by applying first the azo component from a caustic alkaline bath onto the textile material and then treating the textile material thus prepared with the diazonium compound in a commonly slightly acid bath, whereupon the dyestuff is formed.

In the case of azo components and diazonium compounds which are slow to couple, the pH value is supposed to be near the neutral point in order to ensure a satisfactory dyestuff yield (the so-called neutral developing process). Of these components, the compounds specified below are commonly used, among others, in the dyeing practice:

2-Hydroxy-carbazol-1-carboxylic acid-arylamides, for example, 2-hydroxy-carbazol-1-carboxylic acid-4'-chloro-phenylamide (Colour Index, C.I. No. 37600), 2-hydroxy-diphenylene oxide-3-carboxylic acid-arylamides, for example, -2',5'-dimethoxy-phenyl-amide (C.I. 37 605), and 2-hydroxy-11H-benzo[a]carabazol-4-carboxylic acid-arylamides, for example, -4'-methoxy-phenylamide (C.I. 37 595), as well as the diazonium compounds of aminobenzene-carboxylic acid amides, for example of 2-amino-anisol-4-carboxylic acid amide, of benzoylamino-amino-benzenes, for example of 2-benzoylamino-5-amino-4-methoxy-1-methylbenzene (C.I. 37 165), of diamino-diphenyl-amines, for example of 4,4'-diamino-diphenylamine (C.I. 37 245), or of 4,4'-diamino-diphenylene, for example of 4,4'-diamino-3,3'-dimethoxy-diphenyl (C.I. 37 235).

With the exception of the $\beta$-ketocarboxylic acid-arylamides, other azo components used in the ice color technique of the series of the 2-hydroxy-naphthalene-3-carboxylic acid-arylamides (C.I. Nos. 37 505–37 569) as well as diazonium compounds of further amines of the benzene series may also be applied according to the neutral developing process, which often results in advantages with regard to the color yield or the operating speed. In this connection, there are to be mentioned especially the diazo compounds of chloroanilines, for example, 3-chloro-aniline (C.I. 37 005), of chlorotoluidines, for example, 6-chloro-2-amino-toluene (C.I. 37 080), of chloroanisidines, for example, 4-chloro-2-amino-anisol (C.I. 37 120), of aminodiphenyl ethers, for example, 4-chloro-2-amino-diphenyl ether (C.I. 37 070), of amino-benzene-sulfonic acid-amides, for example, 2-amino-toluene-4-sulfonic acid-dimethylamide, or of nitranilines, for example, 4-nitro-2-aminoanisol (C.I. 37 130).

The developing baths for the neutral developing process are prepared from a diazo solution neutralized with sodium hydrogeno-carbonate, and contain besides a surfactant for the fine division of the dyestuff being formed in the liquor, a buffer substance which binds the alkali metal introduced with the impregnation and maintains a constant pH value. For this purpose, use is made of mono- or disodium phosphate or chromium acetate.

However, the neutralizing of the diazotization solution with sodium bicarbonate leads to major difficulties in practice since the carbon dioxide being formed as reaction product forms with the surfactant-containing diazonium solution a large amount of very stable foam which is extremely annoying. A treatment with defoaming agents is not recommended as this would also neutralize the effect of the surfactant used; besides, it is not very effective in the surfactant-containing solution.

It has now been found that an alkali metal borate, such as sodium borate, especially sodium metaborate, can advantageously be used in a process for preparing water-insoluble azo dyestuffs on the fiber by development in the neutral or slightly alkaline range in order to eliminate the excess mineral acid from the surfactant-containing diazo solutions and in order to adjust a pH value in the range of from 5.5 to 8.0, preferably from 6 to 7 (termed "neutralization" in the following).

Thus, the present invention provides an improved process for the production of water-insoluble azo dyestuffs on vegetable fibers, such as material made from cellulose fibres, according to the ice color dyeing, wherein the fibrous material is impregnated at first with an azo component of the ice color technique and the impregnated material is subsequently developed with the diazo solution of an aromatic amine of the ice color technique in the neutral or slightly alkaline range, which improvement is characterized by the use of an alkali metal borate to neutralize the diazo solution used.

The advantage is to be seen in the fact that no gaseous reaction product is formed so that a foaming does not occur, and that the boric acid being formed remains dissolved and thus may serve as buffer substance in the following dyeing process. If its amount is not sufficient for the dyeing process, a further amount of borate or boric acid may, of course, be added, however, the required amount is below the one needed when using sodium hydrogenocarbonate.

The sodium metaborate which is very well soluble may be added to the diazo solution to be neutralized in substance or dissolved in a small amount of water.

Sodium metaborate can be used according to the invention in baths of a high, medium and low goods-to-liquor ratio as well as in the pad dyeing. An equivalent amount of sodium metaborate is used per mole of excess acid, such as hydrochloric acid, which is present in the diazo solution, thus, for example, 1 mole of sodium metaborate for 1 mole of excess hydrochloric acid. This means that according to the diazotization directions used in industry (cf. Naphthol AS-Anwendungsvorschriften, Farbwerke Hoechst AG, No. 4026, 1971) an amount in the range of from 200 to 1000 grams of $NaBO_2$ (corresponding to 420 g to 2.1 kg of $NaBO_2.4H_2O$) per kilogram of diazotized base is required.

As diazo components and coupling components which are used in the process of the invention those compounds are suitable which are common in the ice color technique, especially those suitable for the neutral developing process, for example those compounds that have been described above.

The following Examples serve to illustrate the process of the invention. The parts indicated are parts by weight, the percentages are percentages by weight.

EXAMPLE 1

A mixture of 2.4 parts of ethanol, 2.4 parts of water, 0.8 part of 32% aqueous sodium hydroxide solution and 0.6 part of 33% aqueous formaldehyde is poured over 1.2 parts of 2-hydroxynaphthalene-3-carboxylic acid-(4'-chloro-2'-methoxy-5'-methyl)-phenylamide which is dissolved by stirring. After 10 minutes this solution is poured into 1000 parts of water containing 8.2 parts of 32% aqueous sodium hydroxide solution, 20 parts of sodium chloride and 2 parts of a fatty acid-protein degradation product condensate as surfactant. Afterwards 50 parts of a bleached, boiled and wetted out cotton yarn are introduced into that bath and are treated in the same for 30 minutes, while being moved well, are then removed from the bath, squeezed out, rinsed in a solution of 40 parts of sodium chloride and 1.4 parts of an aqueous 32% sodium hydroxide solution in 1000 parts of water, are squeezed out again and are then introduced into a bath which is prepared as follows: 2.25 Parts of 5-amino-2-benzoylamino-1,4-diethoxy-benzene are stirred with 50 parts of water and 0.25 part of a non-ionogenic oxethylation product commonly used in the ice color technique, 2.7 parts of 32% hydrochloric acid are added, and the mixture is diazotized at about 15° C. with 0.57 part of sodium nitrite which was added as a concentrated aqueous solution. The excess acid is eliminated by adding 1.1 parts of $NaBO_2.4H_2O$, and after the addition of 0.5 part of boric acid the mixture is made up to 1000 parts with water. The textile material having been introduced into this bath was treated therein for 30 minutes at a temperature of from 15° to 25° C., was then taken out and rinsed, soaped and dried as usual. A blue dyeing was obtained with a good color yield and good fastness properties.

EXAMPLE 2

The process is carried out as has been described in Example 1, however, while using the following developing bath: 1.71 Parts of 4-chloro-2-aminotoluene-chlorohydrate are stirred thoroughly with a mixture of 0.19 part of a non-ionogenic oxethylation product, 19 parts of water and 2.2 parts of 32% hydrochloric acid. After diluting the mixture with 29 parts of icecold water, it is diazotized by slowly adding 0.76 part of sodium nitrite dissolved in a small amount of water. Subsequently the mixture is neutralized by introducing, while stirring, 1.25 parts of $NaBO_2.4H_2O$. After the addition of 1 part of boric acid the mixture is made up to 1000 parts with water.

An even red dyeing is obtained with a good color yield and good fastness properties.

EXAMPLE 3

The process is carried out as has been described in Example 1, however, while using instead of the baths indicated in said Example the baths described in the following:

Bottoming bath 1.8 Parts of 2-hydroxy-naphthoic acid-3-(1'-naphthyl)-amide are dissolved in a mixture of 2.1 parts of ethanol, 1.2 parts of an aqueous 38% sodium hydroxide solution and 2.7 parts of water of 40° C., and 0.9 part of 33% aqueous formaldehyde is added. After 10 minutes the mixture is introduced into a solution which contains in 1000 parts of water 8 parts of an aqueous 38% sodium hydroxide solution and 2 parts of a protein degradation product-fatty acid condensate.

Developing bath 1.2 Parts of 2-nitraniline are stirred with 0.12 part of an octadecyl alcohol-polyglycolether and 12 parts of ice water and are diazotized, after adding 3.0 parts of 32% hydrochloric acid, with 0.66 part of sodium nitrite dissolved in a small amount of water. A solution of 1.1 parts of $NaBO_2.4H_2O$ in a small amount of water is then added. Subsequently 1.2 parts of boric acid are added, and the whole is made up to 1000 parts with water.

An even red dyeing is obtained in a good color yield and with good fastness properties.

EXAMPLE 4

The process is carried out as has been described in Example 1, however, while using instead of the baths indicated in said Example the bottoming bath specified in Example 3 and the following developing bath: 3.53 Parts of a dyeing preparation consisting of 40% by weight of 4,4'-dichloro-2-amino-diphenylether, 50% by weight of a reaction product of 1 mole of castor oil and 36 moles of ethylene oxide and 10% by weight of diethylene-glycol-monomethylether, are introduced, while stirring, into a mixture of 5 parts of 32% hydrochloric acid and 24 parts of water of 15° C. Subsequently 0.41 part of sodium nitrite dissolved in a small amount of water is added. The diazotization is completed immediately. The diazo solution is then introduced, while stirring, into 4.4 parts of $NaBO_2.4H_2O$ in 960 parts of water.

An even brilliant red dyeing is obtained in a good color yield and with good fastness properties.

EXAMPLE 5

17.5 Parts of 2-hydroxy-3-naphthoic acid-anilide are introduced, while stirring, into a solution of 90° C. consisting of 24 parts of an aqueous 33% sodium hydroxide solution, 5 parts of a protein degradation product-fatty acid condensate and 970 parts of water, and are dissolved by boiling. A cotton fabric is impregnated with this padding-liquor on a padder with a liquor pick-up of 800 g/kg of material. The material is then dried on a stenter frame and is then padded over in a second padder with the following liquor having a temperature of about 10° C.:

14.4 Parts of 6-chloro-2-amino-toluene chlorohydrate are stirred with a mixture of 1.6 parts of a non-ionogenic polyethylene oxide derivative and 320 parts of ice water. After the addition of 18.5 parts of 32% hydrochloric acid, 0.4 part of sodium nitrite in a small amount of water is slowly added. By introducing 5.3 parts of $NaBO_2$ (free from crystal water) the excess hydrochloric acid is neutralized. 25 Parts of boric acid are also introduced as an additional alkali metal binding agent. Subsequently the mixture is diluted to 1000 parts by volume with water.

Following an air passage of the padded-over fabric of about 1 minute, a hot water passage is performed. Subsequently the material is washed, soaped, rinsed and dried as usual. An even scarlet dyeing is obtained in a good color yield and with good fastness properties.

EXAMPLE 6

The developing of the fabric impregnated according to Example 5 may also be performed on a jig instead of a padder, the operation being effected as follows: The diazo solution of 14.4 parts of 6-chloro-2-amino-toluene-chlorohydrate prepared according to Example 5 is diluted following the addition of 5.3 parts of $NaBO_2$ and 25 parts of boric acid, to a volume of 2400 parts with cold water. In addition, 120 parts of sodium chloride are also dissolved therein. 800 Parts of impregnated fabric are developed with this liquor in the course of 4 passages. Subsequently the bath is acidified as usual (two passages with 3 ml/l of 32% hydrochloric acid), the material is clear-rinsed (two passages with overflow), soaped while being heated (60° C., 4 passages with 1 g/l of nonylphenol-polyglycolether, sodium carbonate and sodium tripolyphosphate each time), rinsed with warm water, soaped while being hot (95° C., 4 passages with 1 g/l of nonylphenol-polyglycolether, sodium carbonate and sodium tripolyphosphate each time) and clear-rinsed with water.

An even scarlet dyeing is also obtained in this case in a good color yield and with good fastness properties.

EXAMPLE 7

In order to prepare a violet dyeing on cotton yarn, a wetted-out cross-wound bobbin with 500 parts of cotton yarn is treated in a dyeing apparatus at first with 5000 parts of a dyeing-liquor containing 12.5 parts of 2-hydroxynaphthalene-3-carboxylic acid-(4'-chloro)-phenylamide, 41 parts of an aqueous 32% sodium hydroxide solution, 6 parts of 33% formaldehyde and 15 parts of a common protective colloid.

After 30 minutes this liquor is pumped off, and the material is rinsed intermediately for 8 minutes with a solution of 100 parts of sodium chloride and 5 parts of a 33% aqueous sodium hydroxide solution in 5000 parts by volume of water. After pumping off this rinsing bath, the goods are treated for 30 minutes with a dyeing-liquor which is prepared as follows: 13.5 Parts of 5-amino-2-benzoyl-amino-4-methoxy-toluene are stirred with 300 parts of water and 1.5 parts of octadecyl-polyglycolether (average molecular weight of 1500) and upon addition of 20 parts of 32% hydrochloric acid are diazotized with 4.5 parts of sodium nitrite in a concentrated aqueous solution at 10° C. The excess acid is eliminated by introducing 6.7 parts of $NaBO_2.2H_2O$; thereafter 4 parts of boric acid are added, and the whole is made up to 5000 parts with water. Subsequently the material is rinsed as usual, is soaped first at 60° C., then at 100° C., then clear-rinsed and dried.

A bobbin which is thoroughly and evenly dyed is obtained in a violet color shade with a good color yield and good fastness properties.

EXAMPLE 8

In order to prepare a brown dyeing on cotton yarn, the process is carried out as has been described in Example 1, however, while using the following bottoming and developing baths:

Bottoming bath 0.9 Part of 2-(3'-hydroxydiphenylene oxide-2'-carbonyl-amino)-1,4-dimethoxy-benzene is dissolved in a mixture of 1.4 parts of ethanol, 1.8 parts of water and 0.62 part of a 32% aqueous sodium hydroxide solution. After a few minutes the solution is poured into a mixture of 8 parts of a 32% aqueous sodium hydroxide solution 3 parts of a protein hydrolyzate-fatty acid condensate, 20 parts of sodium chloride and 1000 parts of water.

Developing bath 1.1 Parts of 5-nitro-2-amino-anisol are stirred with 0.11 parts of octadecyl-polyglycolether and 11 parts of water. After the addition of 2.2 parts of 32% hydrochloric acid, 0.5 part of sodium nitrite dissolved in a small amount of water is introduced. Upon completion of the diazotization, a concentrated aqueous solution of 0.82 part of $NaBO_2.4\ H_2O$ is introduced. After having added 1.2 parts of boric acid, the mixture is made up to 1000 parts with water.

An even full brown dyeing is obtained with a good color yield and good fastness properties.

EXAMPLE 9

In order to obtain a black dyeing of cotton yarn, cotton yarn is impregnated as has been indicated in Example 5; an intermediate drying follows, and the yarn is padded over with a developing liquor on a padder with a liquor pick-up of 80%. This developing liquor was prepared as follows: 10.8 Parts of 4,4'-diamino-diphenylamine-sulfate were dissolved with 1.2 parts of octadecyl-polyglycolether in 36 parts of hot water. After cooling, 72 parts of cold water, 72 parts of ice, 13 parts of 32% hydrochloric acid and then 5.4 parts of sodium nitrite dissolved in a small amount of water, were added. Upon completion of the diazotization, 5.2 parts of $NaBO_2.4H_2O$ and 25 parts of boric acid were introduced, and the mixture was made up to 1000 parts with water. After an air passage of the padded fabric for about 1 minute, a hot water passage follows. Subsequently the material is washed, soaped, rinsed and dried as usual.

An evenly dyed fabric is obtained in a black color shade with good fastness properties and a good color yield.

We claim:

1. A process for the production of water-insoluble azo dye-stuffs on vegetable fibers according to the methods of the ice color technique, wherein the fibrous material is at first impregnated with an azo coupling component and the impregnated material is subsequently developed with a diazo solution of an aromatic amine in the neutral or slightly alkaline range, the improved process is characterized by the use of an alkali metal borate to neutralize the diazo solution.

2. A process as claimed in claim 1, wherein the alkali metal borate used is sodium metaborate.

* * * * *